United States Patent [19]

Blackburn et al.

[11] Patent Number: 5,034,119

[45] Date of Patent: Jul. 23, 1991

[54] NON-CARCINOGENIC BRIGHT STOCK EXTRACTS AND DEASPHALTED OILS

[75] Inventors: Gary R. Blackburn, Washington Crossing, Pa.; Carl R. Mackerer, Pennington, N.J.; Nigel Searle, Essex, England; Arshavir E. Mekitarian, Lawrenceville; Edward N. Ladov, Cherry Hill, both of N.J.

[73] Assignee: Mobil Oil Corporation, Fairfax, Va.

[21] Appl. No.: 329,735

[22] Filed: Mar. 28, 1989

[51] Int. Cl.[5] ..... C10G 41/00

[52] U.S. Cl. ..... 208/309; 208/86; 208/87; 208/88; 208/94; 208/96; 208/97; 208/177; 208/314; 208/347; 208/354; 208/DIG. 1; 435/30; 435/29; 435/34

[58] Field of Search ..... 208/177, 309, 314, 347, 208/354, 86, 87, 88, 94, 96, 97, DIG. 1; 435/30, 29, 34

[56] References Cited

U.S. PATENT DOCUMENTS 3,929,626 12/1975 Button et al. ..... 208/309
4,321,094 3/1982 Batt et al. ..... 106/32
4,499,187 2/1985 Blackburn et al. ..... 435/34
4,869,809 9/1989 Sarna ..... 208/DIG. 1

*Primary Examiner*—Helane E. Myers
*Attorney, Agent, or Firm*—A. J. McKillop; C. J. Speciale; M. J. Mlotkowski

[57] ABSTRACT

Non-carcinogenic bright stock extracts and/or deasphalted oils are produced from reduced hydrocarbon feedstocks. Such non-carcinogenic products are produced by establishing a functional relationship between mutagenicity index and a physical property correlative of hydrocarbon type for the bright stock extract or deasphalted oil and determining a critical physical property level which, when achieved, results in a product having a mutagenicity index of less than about 1.0. Process conditions are established so that a product stream achieving the desired physical property level can be produced. Non-carcinogenic bright stock extracts and/or deasphalted oils are then processed utilizing the conditions so established. A bright stock extract and a deasphalted oil substantilly free from mutagenic activity, as well as processes for their production are also provided herein.

42 Claims, 4 Drawing Sheets

NON-CARCINOGENIC BRIGHT STOCK EXTRACTS AND DEASPHALTED OILS

FIELD OF THE INVENTION

The present invention relates to useful bright stock extracts and deasphalted oils, and to a process for their preparation. More particularly, this invention is directed to non-carcinogenic bright stock extracts and deasphalted oils, and to an improved combination of process steps for their production.

BACKGROUND OF THE INVENTION

In the refining of lubricant base stocks, a series of generally subtractive processes is employed to remove undesirable components from the process feedstock. The most important of these processes include atmospheric and vacuum distillation, deasphalting, solvent extraction, and dewaxing. These processes are basically physical separation processes in the sense that if all the separated fractions were recombined it would reconstitute the crude oil.

Refineries do not manufacture a single lube base stock but rather process several distillate fractions and a vacuum residuum fraction. Generally, at least three distillate fractions differing in boiling range and the residuum may be refined. These four fractions have acquired various names in the refining art, the most volatile distillate fraction often being referred to as the "light neutral" fraction or oil. The other distillates are called "intermediate neutral" and "heavy neutral" oils. The vacuum residuum, after deasphalting, solvent extraction and dewaxing, is commonly referred to as "bright stock." Thus, the manufacture of lubricant base stocks involves a process for producing a slate of base stocks, which slate includes at least one refined distillate and one bright stock. Additionally, each subtractive step produces a byproduct which may be processed further or sold to an industry which has developed a use for the byproduct.

Conventional processing of crude petroleum oil to recover fractions suitable for upgrading in various refinery processing operations employs multi-stage distillation. Crude oil is first distilled or fractionated in an atmospheric distillation tower, with residual material from the bottom of the distillation tower being further separated in a vacuum distillation tower. In this combination operation, gas and gasoline generally are recovered as overhead products of the atmospheric distillation tower, heavy naphtha, kerosene and gas oils are taken off as distillate side streams and the residual material is recovered from the bottom of the tower as reduced crude. Steam may be introduced to the bottom of the tower and various side strippers used to remove light material from withdrawn heavier liquid products. The residual bottoms fraction or reduced crude is usually charged to a vacuum distillation tower. The vacuum distillation step in lube refining provides one or more raw stocks within the boiling range of about 550° F. to 1050° F., as well as the vacuum residuum byproduct. Often the vacuum charge is heated by a furnace means in order to vaporize a portion of the charge. The preheated charge normally enters a lower portion of the vacuum tower and the vapors therefrom rise through the tower where they are cooled in selected stages producing successively lighter liquids which are separately withdrawn as the sidestream raw stock products. In lube refining, excess liquid runback, known as overflash material, may be combined with the vacuum residuum and either withdrawn from the tower or charged to a deasphalting unit for further processing or dealt with in other conventional ways known to those skilled in the art. The overflash material may alternatively be withdrawn, recovered and charged directly to a solvent extraction unit. The presence of metallic impurities, asphaltenes and the like may render this material unsuitable for this step or likewise, for a catalytic processing step. Typical vacuum distillation systems are disclosed in U.S. Pat. Nos. 2,713,023, 3,886,062, 4,239,618 and 4,261,814, incorporated herein by reference in their entirety. Vacuum tower designs particularly germane to the present invention are disclosed in U.S. Pat. Nos. 3,929,626 and 3,989,616, which are hereby incorporated by reference in their entirety.

Following vacuum distillation, each raw stock is extracted with a solvent, e.g. furfural, phenol or chlorex, which is selective for aromatic hydrocarbons, removing undesirable components. The vacuum residuum usually requires an additional step, typically propane deasphalting, to remove asphaltic material prior to solvent extraction. The products produced for further processing into base stocks are known as raffinates. The raffinate from solvent refining is thereafter dewaxed by admixing with a solvent such as a blend of methyl ethyl ketone and toluene, for example and then processed into finished base stocks.

The solvent extraction step separates hydrocarbon mixtures into two phases; the previously described raffinate phase which contains substances of relatively high hydrogen to carbon ratio, often called paraffinic type materials, and an extract phase which contains substances of relatively low hydrogen to carbon ratio often called aromatic type materials. Solvent extraction is possible because different liquid compounds have different solution affinities for each other and some combinations are completely miscible while other combinations are almost immiscible. The ability to distinguish between high carbon to hydrogen aromatic type and low carbon to hydrogen or paraffinic type materials is termed selectivity. The more finely this distinguishing can be done the higher the selectivity of the solvent.

Furfural is typical of a suitable solvent extraction agent. Its miscibility characteristics and physical properties permit use with both highly aromatic and highly paraffinic oils of wide boiling range. Diesel fuels and light and heavy lubricating stocks are refined with furfural. Furfural exhibits good selectivity at elevated temperatures (175°-250° F.). In a typical furfural solvent extraction unit for lubricating oils, the raw feed is introduced below or about at the center of the extraction tower. Furfural is fed into the top or upper portion of the tower. Recycled extract may be introduced into the lower section of the tower as reflux. Likewise, internal reflux is effected in the tower by the temperature gradient which is brought about by introducing the solvent at an elevated temperature and by intermediate cooling systems. Furfural solvent is recovered from the raffinate and extract phase streams or layers in suitable distillation and stripping equipment. The stripped and recovered solvent is then recycled.

While the furfural solvent extraction unit raffinate goes on to further processing, the extract from the operation often finds utility in a broad range of industrial applications. Applications for these aromatic extracts often vary according to the particular properties of the extracts, these properties largely a function of the feedstock used and unit conditions. For example, as described in "A New Look at Oils in Rubber" by H. F. Weindel and R. R. Terc, *Rubber World*, December, 1977, these extracts often find further utility as low and high viscosity aromatic extender oils for rubber processing. Bright stock extracts (BSE), obtained by solvent-refining deasphalted vacuum resids during the production of bright stocks, are also useful in rubber processing and find utility as ink oils as well. Like the lighter aromatic extracts, BSE's possess excellent solvent characteristics which lend themselves to great potential utility.

Besides having utility as a feedstock to the solvent extraction unit, the raffinate stream of the deasphalting unit can find further utility as a specialty oil. Depending on its characteristics, this stream, also known as deasphalted oil (DAO), can find utility as an extender oil for rubber processing, an ink oil, etc.

In recent years, concerns have arisen regarding the potential hazards associated with the use of various aromatic oils, DAO's and BSE's. As noted in U.S. Pat. No. 4,321,094, at col. 2, lines 9–14, ". . . many printing ink oils still contain proportions of aromatic hydrocarbons which either are proven to be carcinogenic, such as benzene, or are believed to be carcinogenic, such as toluene and polycyclic compounds. Clearly elimination of these from an ink would be desirable for health reasons." As a result of these concerns, many refiners are no longer willing to supply DAO's or aromatic extracts, including BSE's, for these speciality applications. Those refiners that continue to market these products must provide labels outlining the potential risks associated with the use of these products. This has led to the development and selection of alternate materials for applications previously fulfilled by DAO's and BSE's, as evidenced by U.S. Pat. Nos. 4,321,094 and 4,519,841. The use of these alternative solvents often carries with it the penalty of higher cost and inferior finished product quality.

To determine the relative carcinogenic activity of a deasphalted oil or an aromatic extract such as a BSE, a reliable test method for assaying such activity in complex hydrocarbon mixtures is required. A highly reproducible method showing strong correlation with the carcinogenic activity index of hydrocarbon mixtures is disclosed in U.S Pat. No. 4,499,187, which is incorporated by reference in its entirety. From the testing of hydrocarbon samples as disclosed in U.S. Pat. No. 4,499,187, a property of the sample, known as its Mutagenicity Index (MI) is determined. Hydrocarbon mixtures exhibiting MI's less than or equal to 1.0 are known to be non-carcinogenic, while samples exhibiting MI's equal to about 0.0 are known to be completely free of mutagenic activity. It would be desirable to produce deasphalted oils and/or aromatic extracts such as bright stock extracts which are non-carcinogenic such that contact with same will not cause the development of cancerous growths in living tissue. It would be still more desirable to produce DAO's and/or BSE's which are free of mutagenic activity; that is, that contact with such products would not induce mutations in DNA and in living cells.

It is, therefore, an object of this invention to provide a substantially non-carcinogenic bright stock extract.

It is a further object of this invention to provide a substantially non-carcinogenic deasphalted oil.

It is another object of this invention to provide a process for making a substantially non-carcinogenic bright stock extract.

It is a yet further object of this invention to provide a process for making a substantially non-carcinogenic deasphalted oil.

Yet another object of this invention is to provide a bright stock extract substantially free from mutagenic activity.

It is still yet another object of this invention to provide a deasphalted oil substantially free from mutagenic activity.

Still yet a further object of this invention is to provide a process for making a bright stock extract which is substantially free from mutagenic activity.

It is still yet another object of this invention to provide a process for making a deasphalted oil which is substantially free from mutagenic activity.

SUMMARY OF THE INVENTION

In accordance with the present invention, a non-carcinogenic bright stock extract and a non-carcinogenic deasphalted oil are provided, as well as processes for their production from reduced hydrocarbon crude feedstocks. The process for the production of the non-carcinogenic bright stock extract (BSE) from a reduced hydrocarbon crude feedstock comprises establishing a functional relationship between mutagenicity index (MI) and a physical property correlative of hydrocarbon type for a bright stock extract stream. From this relationship, a critical physical property level is determined which, when achieved, the resultant BSE exhibits an MI less than or equal to 1.0. Process conditions are established to consistently achieve the desired BSE physical property level. Reduced feedstock is then fed into a vacuum distillation column wherein the feedstock is separated into at least one product of distillation and a residuum byproduct. Next, at least a fraction of the residuum is fed into a selective solvent deasphalting unit to produce a deasphalted raffinate and an asphaltenic or tar extract. Then, at least a fraction of the deasphalted raffinate is passed through at least one solvent extraction step to reduce the deasphalted raffinate's aromatic content and to produce a bright stock raffinate and a bright stock extract, the bright stock extract having an MI less than or equal to about 1.0. The BSE so produced is substantially non-carcinogenic. A BSE substantially free from mutagenic activity is also provided as well as a process for producing same. The 5% distillation boiling point has been found to be a particularly preferred physical property of the BSE for correlation with MI.

The process for the production of the non-carcinogenic deasphalted oil (DAO) comprises establishing a functional relationship between mutagenicity index (MI) and a physical property correlative of hydrocarbon type for a deasphalted oil stream. From this relationship, a critical physical property level is determined which, when achieved, the resultant DAO exhibits an MI less than or equal to 1.0. Process conditions are established to consistently achieve the desired DAO physical property level. Reduced feedstock is then fed into a vacuum distillation column wherein the feedstock is separated into at least one product of distillation and a residuum byproduct. Next, at least a fraction of the residuum is fed into a selective solvent deasphalting unit to produce a deasphalted oil and an asphaltenic or tar extract, the DAO having an MI less than or equal to about 1.0. The DAO so produced is substantially non-carcinogenic. A DAO substantially free from mutagenic activity is also provided as well as a process for producing same. The 5% distillation boiling point is believed to be a particularly preferred physical property of the DAO for correlation with MI.

DETAILED DESCRIPTION OF THE INVENTION

Figure 1:
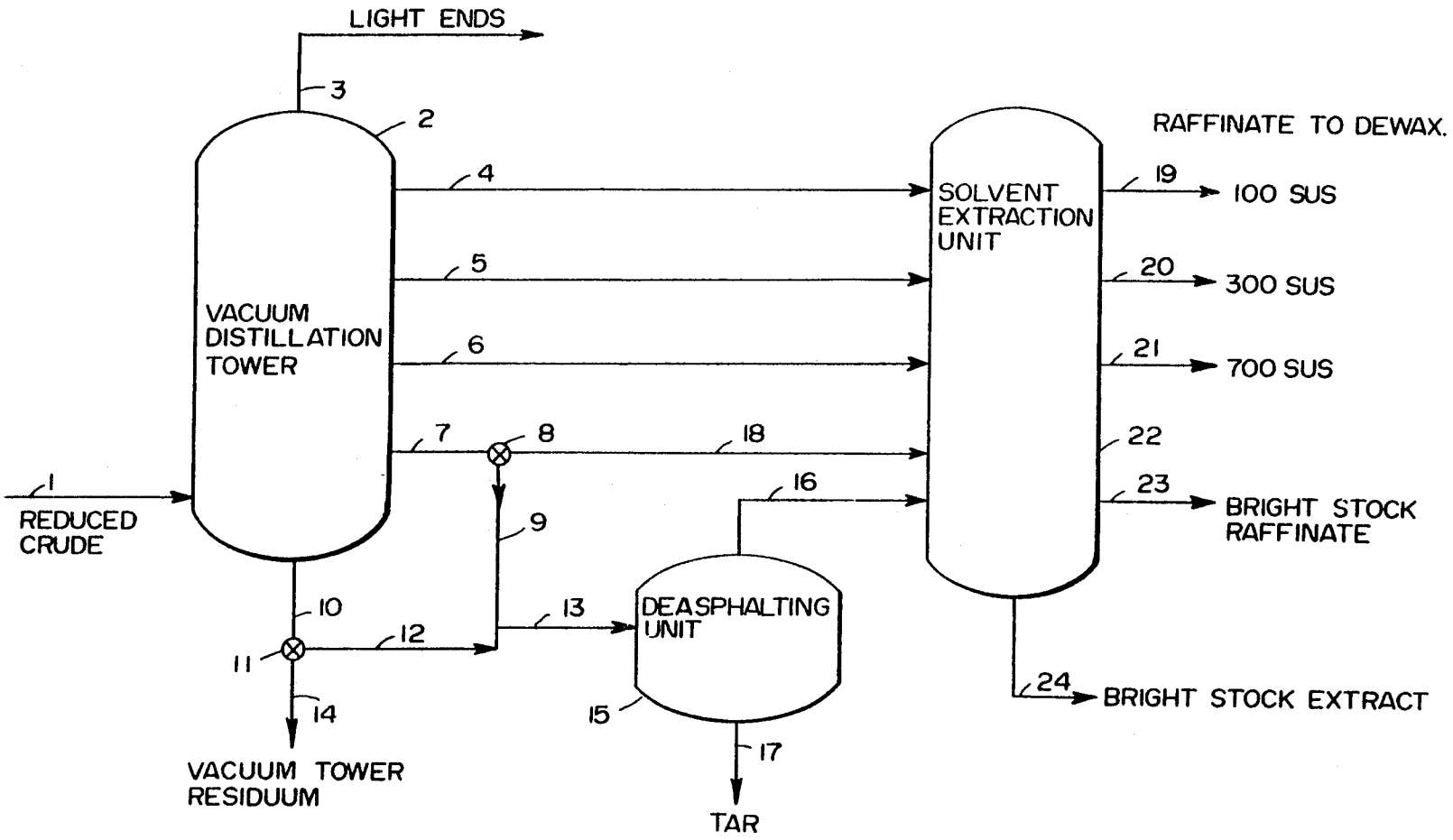
FIG. 1. A partial lubricant refinery configuration schematically representing the steps of vacuum distillation, deasphalting and solvent extraction, wherein a blended overflash and vacuum residuum feed to a deasphalting unit is utilized.

Any lubricant refinery which utilizes a solvent extraction step and/or a deasphalting step in the production of bright stocks is contemplated for use herein. The process of this invention will now be described with reference to FIG. 1, which schematically depicts a particularly preferred lubricant refinery partial configuration. A suitable reduced crude prepared by atmospheric pressure distillation of a paraffin base or other suitable base crude oil is passed via line 1 to crude unit vacuum distillation tower 2. Light ends are removed from the system via line 3. A light distillate fraction, which is a raw lubricant stock, known as light neutral oil, is passed from tower 2 via line 4 either to a storage tank, not shown, or to the solvent extraction unit 22 for further processing. Similarly, an intermediate neutral oil is passed via line 5, and a heavy neutral oil is passed via line 6, either to storage tanks (not shown) or to solvent extraction unit 22. An overflash boiling range material is withdrawn from conduit 7 located at a lower portion of the vacuum tower 2 above the reduced crude inlet conduit 1. Vacuum tower residuum is withdrawn from conduit 10. A portion of the vacuum tower residuum withdrawn from conduit 10 is withdrawn by conduit 12 and a portion of the overflash material withdrawn by conduit 7 is withdrawn by conduit 9. These portions are withdrawn and combined in conduit 13 and passed to deasphalting unit 15, where it is treated by any of a number of useful processes, such as propane deasphalting (PDA), which is particularly preferred. The overflash material not withdrawn by conduit 9 for combining with the residuum is withdrawn by conduit 18 and may be stored in tankage, not shown, or solvent treated in extraction unit 22. The residuum not withdrawn by conduit 12 will pass through conduit 14 and may be stored in tankage (not shown) or processed further as desired. Upon deasphalting, the deasphalted oil product, or raffinate, is withdrawn through conduit 16 and, either sent for further processing into bright stock or withdrawn and stored as DAO via conduit 26. The extract or tar from the deasphalting step is withdrawn through conduit 17. If bright stocks are to be produced, at a suitable point in time, the deasphalted oil raffinate is passed to a solvent extraction unit 22 through conduit 16 where it is treated with any one of a number of suitable solvents to remove undesirable constituents by preferential solution to produce a lubricant bright stock raffinate. The bright stock raffinate so produced is passed via conduit 23 and the bright stock extract removed via conduit 24. As mentioned, in the extraction unit 22, any suitable selective solvent may be used, such as furfural, phenol, chlorex, nitrobenzene, n-methylpyrrolodone, or others, with furfural being a particularly preferred solvent. At an appropriate point in time, the flow from conduit 16 is halted and flow from either conduit 4, 5 or 6 substituted therefor. The extraction unit will again remove the unwanted aromatic compounds and the light (100 SUS), intermediate (300 SUS) or heavy (700 SUS) neutral oil raffinate so produced, removed via conduit 19, 20 or 21, respectively. The raffinates processed by the solvent extraction unit are dewaxed using any suitable process or stored in tankage (not shown) for later processing.

It will be recognized by those skilled in the art that the process stages described above are conventional. The illustration chosen shows the preparation of four segregated base stocks, but of course fewer or more distillate fractions may be prepared. With certain highly paraffinic raffinates, which are substantially free of asphalt, treatment in the deasphalting unit 15 may be omitted. In other cases, unit 15 may provide a combined deasphalting and solvent extraction process. These and other variants are contemplated as within the scope of the present invention, the variations not being of material significance since they are not at the point of novelty of the present invention. It will be further recognized by those skilled in the art that the process being described is a blocked-out operation, but that variants thereof which would provide continuous flow of a deasphalted raffinate, for example, via line 16 to a dedicated extraction unit (not shown) and thence via conduit 23 to a storage tank or dewaxing unit (both not shown), are contemplated as within the scope of the present invention.

Depending upon whether the production of non-carcinogenic bright stock extract or non-carcinogenic deasphalted oil is desired, samples are withdrawn from either conduit 24 (for the bright stock extract) or conduit 26 (for the deasphalted oil) during preliminary runs, or from storage tanks (not shown) where previously collected samples reside. It can be beneficial to note the processing conditions responsible for producing a particular sample. Important parameters may include, but are not limited to: (1) percent of overflash material blended with crude unit vacuum tower residuum for charging the deasphalting unit; (2) the heavy-neutral distillate cut point; (3) other vacuum tower operating parameters such as steam inlet temperature, flashing zone absolute pressure and other internals; (4) deasphalting unit operating conditions, such as solvent treatment rate; (5) solvent extraction unit charge properties, such as whether blends of other streams are charged to the unit together with the deasphalted raffinate; and (6) solvent extraction unit operating conditions such as solvent treatment rate. Although not found to influence the production of the DAO's and BSE's of this invention, another variable worthy of note may be the crude or crude blend charged to the atmospheric distillation unit for producing the reduced crude charged to the crude unit vacuum distillation tower.

It has been discovered that polynuclear aromatic compounds (PAC) of 3–7 rings are responsible for the mutagenic/carcinogenic activity of DAO's and BSE's. These biologically active PAC are generally considered to fall in the boiling range of 640° to 1000° F. Unfortunately, suitable methods for reliably detecting these PAC's in deasphalted oil or bright stock extract-type materials do not exist. It has been found, however, that the distillation properties of a DAO or a BSE, in particular, the 5% boiling point, can provide a process parameter indicative of the relative mutagenicity/carcinogenicity of a particular DAO or BSE process stream. Also, the initial boiling point (IBP) of the DAO or BSE has been found to provide another useful process parameter indicative of relative mutagenicity/carcinogenicity.

Figure 3:
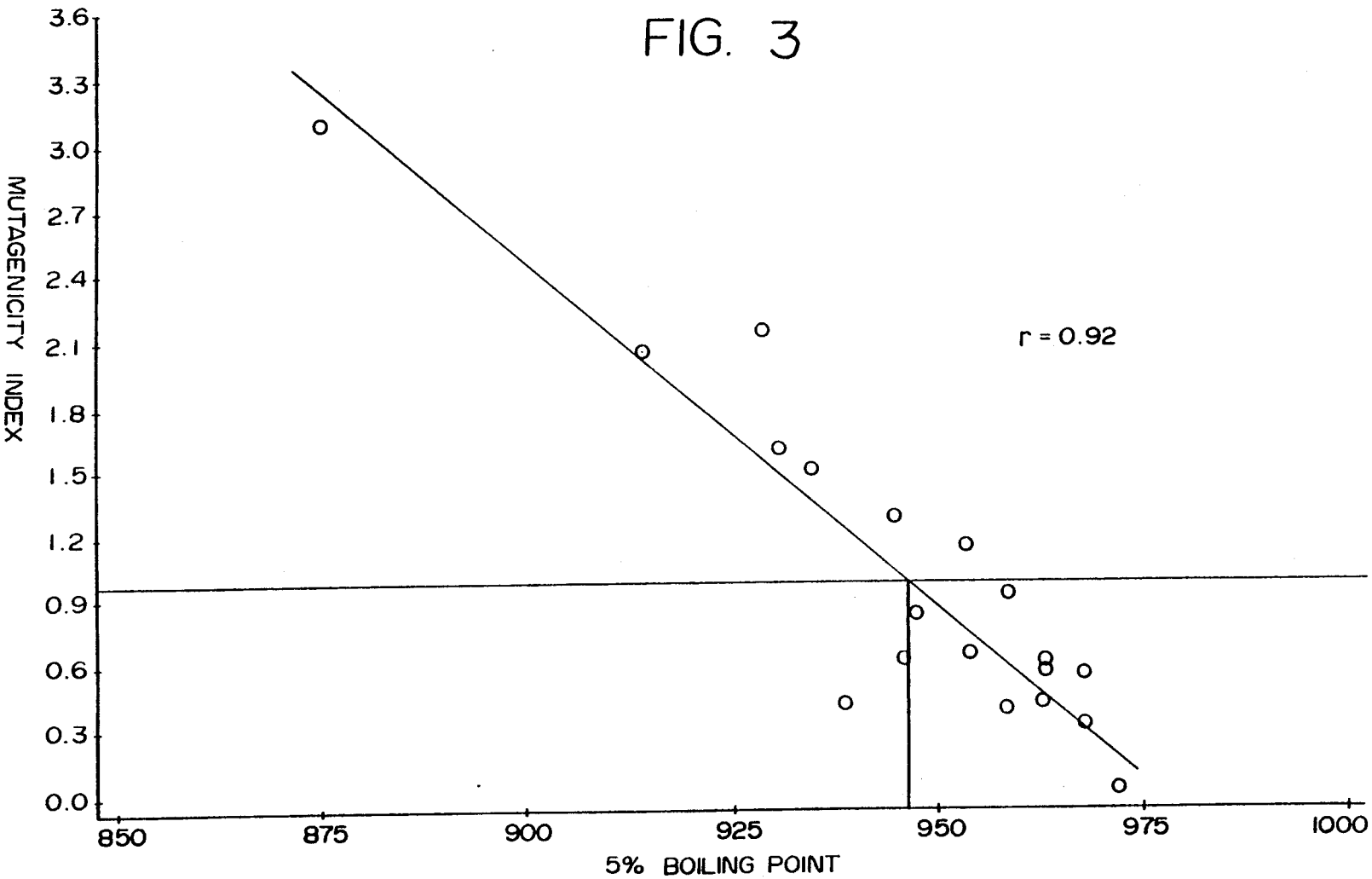
FIG. 3. Relationship between Mutagenicity Index, as determined by a Modified Ames Assay, and the 5% boiling point for 19 BSE's produced by Refinery A.

The bright stock extract or deasphalted oil samples collected are distilled using a standard method, such as ASTM D-1160, with preferably, at least the 5% boiling point (BP) recorded for each sample. Each sample is also tested to determine its relative mutagenicity. The Modified Ames Assay procedure disclosed in U.S. Pat. No. 4,499,187 is particularly preferred as it can rapidly and reliably determine the potential carcinogenic activity of hydrocarbon mixtures of petroleum origin. Mutagenicity index data obtained from the Modified Ames tests and 5% BP data obtained from distillation tests are regressed using well-known simple linear regression techniques to develop a linear relationship between these parameters characteristic of that refinery's basic operation. Mutagenicity index (MI), as disclosed in U.S. Pat. No. 4,499,187, is a ranking for relative mutagenic potency. MI is the slope of the dose response curve for mutagenesis. An example of such a regression line is shown in FIG. 3. Since non-carcinogenic oils are known to exhibit MI's of less than or equal to 1.0, the 5% BP which yields a value of MI=1.0 is determined from the regression relationship and selected as the "critical" 5% BP. Process conditions selected to produce a DAO and/or a BSE (as desired) having a 5% BP at or above the critical 5% BP value will be non-carcinogenic. As may be seen from the regression relationship of FIG. 3, BSE's can also be produced having no mutagenic activity at all when they are produced to have a 5% BP at or above the point where MI=0. Likewise, DAO's free from mutagenic activity can also be produced in the same manner.

Reference is again made to FIG. 1. As mentioned, to achieve a DAO and/or a BSE having a 5% BP at or above the critical value, processing alterations will likely be required. One alteration found to influence the distillation characteristics of the resultant DAO or BSE is the amount of overflash material blended with the vacuum residuum for charging the deasphalting unit 15. Should the lube refining process of FIG. 1 be present, the settings of valves 8 and/or 11, should they be present, could be varied to reduce the percentage of overflash material charged to the deasphalting unit. While the use of an overflash/residuum blend as a deasphalting unit charge is desirable from the standpoint that it increases the amount of bright stock produced while also producing bright stocks of somewhat lower viscosity, its use can now be optimized so that substantially non-carcinogenic deasphalted oils and/or bright stock extracts are also produced.

Figure 2:
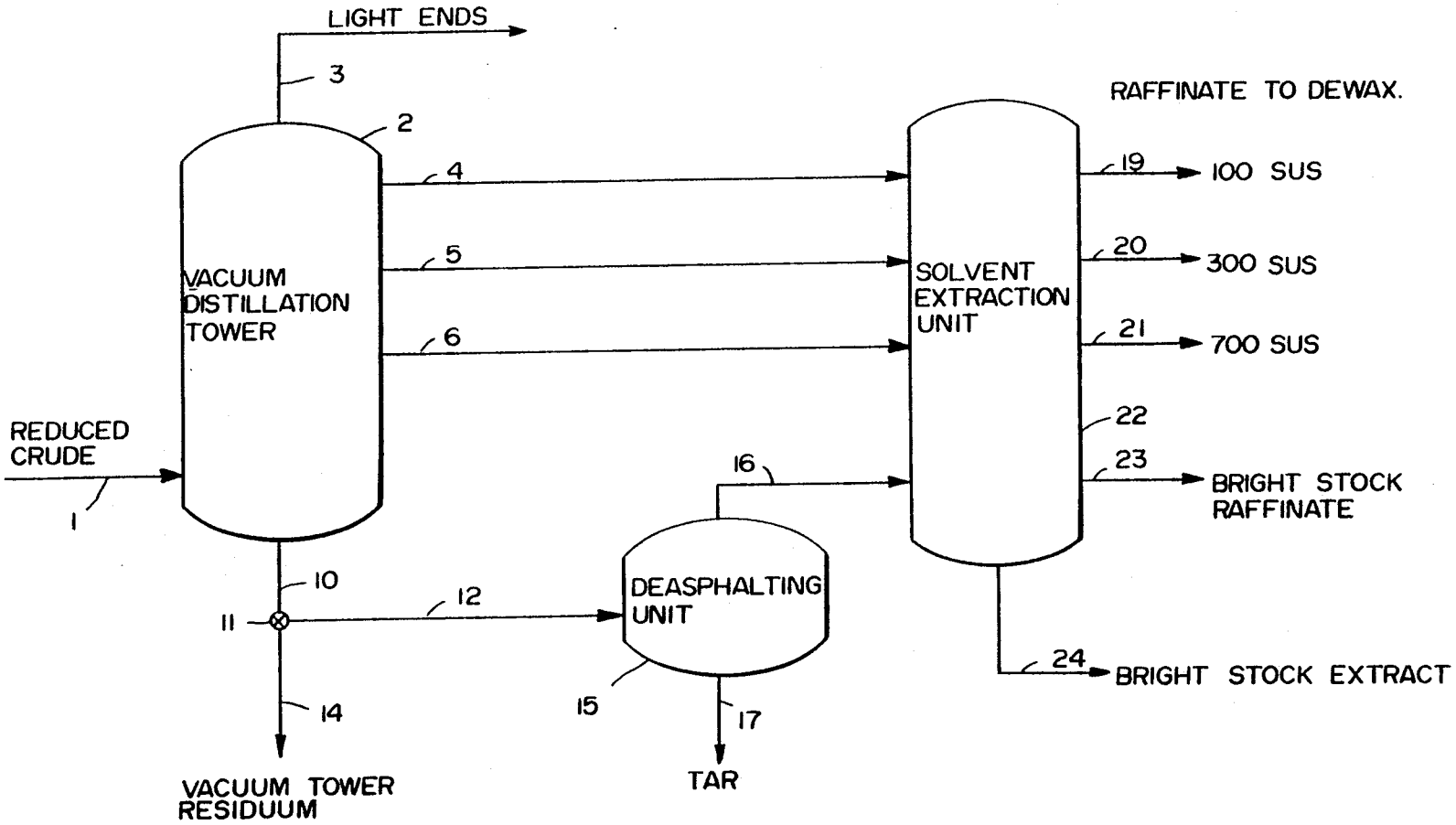
FIG. 2. A partial lubricant refinery configuration schematically representing the steps of vacuum distillation, deasphalting and solvent extraction wherein a straight vacuum residuum feed to a deasphalting unit is utilized.

It is important to recognize that the process of this invention is not limited to the lube refining processes depicted in FIG. 1 and explained above. Another partial lubricant refinery configuration useful in the practice of this invention is depicted in FIG. 2. The configuration shown in FIG. 2 is similar to that of FIG. 1, with the exception that no overflash side-draw is present for removal and blending with residuum for charging to the deasphalting unit 15. The process for producing a non-carcinogenic DAO or BSE would be carried out as described above, with the exception that no ability to alter the 5% BP of the end-product by varying the percentage of overflash charged to the deasphalting unit would exist. Other process condition alterations, such as those described above or others known to those possessing ordinary skill in the art would be required and are envisioned as useful in the practice of this invention.

The invention is illustrated by the following examples.

EXAMPLE 1

In accordance with the process previously described, nineteen bright stock extracts were produced under varied process conditions at Refinery A, using various input crude blends, with representative samples of each taken. Mutagenicity tests were conducted using the Modified Ames Assay procedure previously referred to with two additional modifications. These were: a higher dose range (10–80 rather than the standard 5–50 μl/plate) was employed, in keeping with the lower mutagenicity of these materials relative to that observed for typical vacuum distillates, the amount of sample extracted for testing was 2 grams rather than the 2 ml used for less viscous materials. Distillation profiles were obtained for each sample using ASTM D-1160. Data obtained are shown in Table 1 below.

TABLE 1

PROPERTIES OF BRIGHT STOCK EXTRACTS FROM REFINERY A

| Sample Number | Mutagenicity Index | 5% BP (°F.) | DESCRIPTION |
|---|---|---|---|
| 1 | 3.1 | 875 | Blended with heavy neutral extract; viscosity = 69.7 cSt |
| 2 | 2.0 | 915 | Furfural treat: 300%; PDA treat: 600% |
| 3 | 2.1 | 929 | Contains overflash; IBP = 718° F.; viscosity = 70.6 cSt |
| 4 | 1.6 | 931 | Furfural treat: 370%; PDA treat 600%; crude source: 13% Clyde, 11% Arab Light, 4% Beryl, 20% Statfjord, 52% Fulmar; IBP = 809° F.; viscosity = 61.3 cSt |
| 5 | 1.7 | 935 | 70% Statfjord, 30% Arab Light; viscosity = 50.3 |
| 6 | 1.3 | 945 | Furfural treat: 300%; PDA treat: 600%; crude source: 76% Statfjord, |

TABLE 1-continued

PROPERTIES OF BRIGHT STOCK EXTRACTS FROM REFINERY A

| Sample Number | Mutagenicity Index | 5% BP (°F.) | DESCRIPTION |
|---|---|---|---|
| | | | 17% Beryl, 7% Fulmar; viscosity = 65.7 cSt |
| 7 | 1.1 | 954 | Furfural treat 300%; PDA treat 600%; crude source 80–90% Fulmar, 10–20% Arab Light; viscosity 68.23 cSt |
| 8 | 0.9 | 957 | Furfural treat = 300%; PDA treat = 600%; crude source: 54% Fulmar, 30% Statfjord, 13% Clyde, 3% Arab Light |
| 9 | 0.8 | 947 | Furfural treat: 300%, PDA treat: 600% crude source: Statfjord/ Fulmar; viscosity = 64.0 cSt |
| 10 | 0.6 | 945 | Furfural treat: 300%; PDA treat: 600%; crude source: Statfjord/ Fulmar; viscosity = 65.4 cSt |
| 11 | 0.6 | 954 | Furfural treat: 300%; PDA treat: 600%; crude source: Statfjord/ Fulmar; viscosity = 66.0 cSt |
| 12 | 0.6 | 962 | Furfural treat: 300%; PDA treat: 600%; crude source: 85% Statfjord, 15% Fulmar; viscosity = 63.2 cSt |
| 13 | 0.5 | 962 | Furfural treat: 300%; PDA treat: 600%; crude source: 52% Statfjord, 33% Fulmar, 11% Clyde, 4% Arab Light |
| 14 | 0.0 | 968 | Furfural treat: 300%; PDA treat: 600%, crude source: 52% Statfjord, 33% Fulmar, 11% Clyde, 4% Arab Light |
| 15 | 0.4 | 939 | From North Sea crude; viscosity = 68 cSt |
| 16 | 0.4 | 958 | Viscosity = 70.3 cSt |
| 17 | 0.4 | 962 | Furfural treat: 350%; PDA treat: 600%; crude source: 59% Statfjord, 18% Beryl, 15% Fulmar, 4% Clyde, 4% Arab Light |
| 18 | 0.3 | 968 | Furfural treat: 350%; PDA treat: 600%; crude source: 59% Statfjord, 18% Beryl, 15% Fulmar, 4% Clyde, 4% Arab Light |
| 19 | 0.0 | 973 | Furfural treat: 370%; PDA treat: 600%; crude source: 2% Clyde, 2% Arab Light, 13% Beryl, 79% Statfjord, 4% Fulmar; IBP = 873° F.; viscosity = 54.5 cSt |

The 5% BP and MI data were linearly regressed using well-known techniques to determine the relationship between those variables. The results of this regression are shown in FIG. 3. As shown in FIG. 3, excellent correlation was established, with a correlation coefficient, r, of 0.92 found. The critical 5% BP (MI=1) was found to be about 945° F. for Refinery A. Additionally, from this relationship, it can be seen that a BSE having substantially no mutagenic activity (MI=0) should be produced when the 5% BP exceeds about 978° F.

Knowing the critical 5% BP required to produce a substantially non-carcinogenic BSE, process conditions can be established, as one skilled in the art would recognize, to achieve BSE production consistently having a 5% BP at or above the critical value. Non-carcinogenic bright stock extract can then be produced using the processes previously described. Following these process steps will result in the non-carcinogenic BSE of this invention.

EXAMPLE 2

At Refinery B, five bright stock extracts were produced under varied process conditions and sampled. As in Example 1, MI and 5% BP were determined for each sample. These data are shown below in Table 2.

TABLE 2

PROPERTIES OF BRIGHT STOCK EXTRACTS FROM REFINERY B

| Sample Number | Mutagenicity Index | 5% BP (°F.) | SAMPLE DESCRIPTION |
|---|---|---|---|
| 20 | 2.2 | 879 | BSE, viscosity = 70.3 cSt |
| 21 | 2.1 | 887 | BSE, viscosity = 70.3 cSt |
| 22 | 1.6 | 884 | BSE, viscosity = 70.3 cSt |
| 23 | 1.5 | 904 | BSE, viscosity = 70.3 cSt |
| 24 | 1.1 | 921 | BSE, viscosity = 70.3 cSt |

Figure 4:
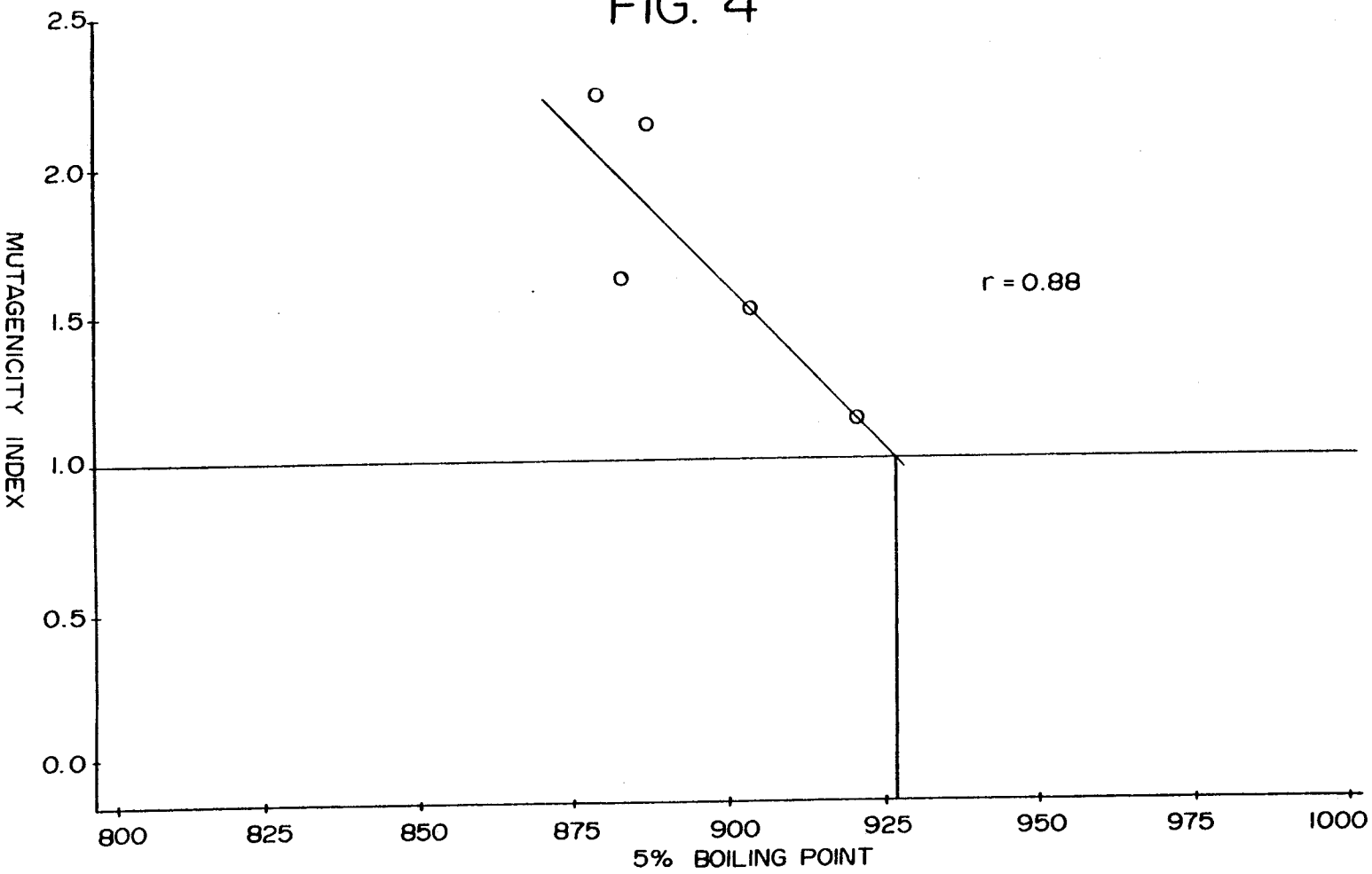
FIG. 4. Relationship between Mutagenicity Index, as determined by a Modified Ames Assay, and the 5% boiling point for 5 BSE's produced by Refinery B.

The 5% BP and MI data were linearly regressed to determine the relationship characteristic of Refinery B. The results of this regression are shown in FIG. 4. Again, excellent correlation is achieved, with an r value of 0.88 found. The critical 5% BP was found to be about 925° F. for Refinery B. Again, as at Refinery A, a BSE substantially free from mutagenic activity should be produced when the 5% BP exceeds about 978° F.

Using the knowledge of one skilled in the art, Refinery B's process conditions can be adjusted to achieve BSE production consistently having 5% BP's at or above the critical value of 925° F. The bright stock extract can then be produced in the manner previously described. By following these process steps non-carcinogenic BSE's can be produced.

EXAMPLE 3

At a lubricant refinery configured substantially as depicted in FIG. 1, ten deasphalted oils are produced under varied process conditions during trial runs and sampled. As in Examples 1 and 2, MI and 5% BP are determined for each sample and linearly regressed. The critical 5% BP is determined from the regression relationship so obtained.

Using the knowledge of one skilled in the art, refinery process conditions are adjusted to achieve DAO production consistently having 5% BP's at or above the critical value. The deasphalted oil can then be produced in the manner previously described. By following these process steps non-carcinogenic DAO's are produced.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

We claim:

1. A process for the production of a substantially non-carcinogenic deasphalted oil from a reduced hydrocarbon crude feedstock, comprising the steps of:
   (a) establishing a functional relationship by regression between mutagenicity index and a deasphalted oil physical property indicative of mutagenicity for a deasphalted oil process stream;
   (b) determining from said relationship a critical physical property level which, when achieved, a deasphalted oil having a mutagenicity index of less than about 1.0 results, said critical property being the physical property which yields a value of mutagenicity index equal to 1.0;
   (c) setting process conditions to produce a deasphalted oil achieving said critical physical property level; and
   (d) producing a deasphalted oil, said deasphalted oil producing step comprising:
      (i) passing the reduced feedstock into a vacuum distillation column wherein the feedstock is separated into at least one product of distillation and a vacuum residuum byproduct; and
      (ii) passing at least a fraction of said residuum byproduct through a selective solvent deasphalting unit to produce a deasphalted raffinate and an asphaltenic extract, wherein said deasphalted oil is substantially non-carcinogenic having a mutagenicity index of less than about 1.0.

2. The process of claim 1, wherein said physical property is a distillation property.

3. The process of claim 2, wherein said distillation property is a distillation boiling point value.

4. The process of claim 3, wherein said distillation boiling point value is selected from the group consisting of initial boiling point and 5% boiling point.

5. The process of claim 4, wherein the selective solvent of said selective solvent deasphalting unit is propane.

6. The process of claim 4, wherein an overflash material is produced by step (d) (i) and at least a portion of this material is combined with said vacuum residuum and processed according to step (d) (ii).

7. The process of claim 6, wherein step (c) includes setting an amount of overflash material for combining with said vacuum residuum prior to selective solvent deasphalting.

8. The process of claim 7, wherein said amount of overflash material is selected to provide a maximum deasphalted oil yield.

9. The process of claim 8, wherein said amount of overflash material does not exceed about 10 volume percent of selective solvent deasphalting unit feedstock.

10. A process for the production of a non-carcinogenic deasphalted oil substantially free from mutagenic activity from a reduced hydrocarbon crude feedstock, comprising the steps of:
   (a) establishing a functional relationship by regression between mutagenicity index and a deasphalted oil physical property indicative of mutagenicity for a deasphalted oil process stream;
   (b) determining from said relationship a physical property level which, when achieved, a deasphalted oil having a mutagenicity index equal to about 0.0 results, said critical property being the physical property which yields a value of mutagenicity index equal to 0.0;
   (c) setting process conditions to produce a deasphalted oil achieving said physical property level; and
   (d) producing a deasphalted oil, said deasphalted oil producing step comprising:
      (i) passing the reduced feedstock into a vacuum distillation column wherein the feedstock is separated into at least one product of distillation and a vacuum residuum byproduct; and
      (ii) passing at least a fraction of said residuum byproduct through a selective solvent deasphalting unit to produce a deasphalted raffinate and an asphaltenic extract, wherein said deasphalted oil is substantially free from mutagenic activity having a mutagenicity index of equal to about 0.0.

11. The process of claim 10, wherein said physical property is a distillation property.

12. The process of claim 11, wherein said distillation property is a distillation boiling point value.

13. The process of claim 12, wherein said distillation boiling point value is selected from the group consisting of initial boiling point and 5% boiling point.

14. The process of claim 13, wherein the selective solvent of said selective solvent deasphalting unit is propane.

15. The process of claim 13, wherein an overflash material is produced by step (d) (i) and at least a portion of this material is combined with said vacuum residuum and processed according to step (d) (ii).

16. The process of claim 15, wherein step (c) includes setting an amount of overflash material for combining with said vacuum residuum prior to selective solvent deasphalting.

17. The process of claim 16, wherein said amount of overflash material is selected to provide a maximum bright stock yield.

18. The process of claim 17, wherein said amount of overflash material does not exceed about 10 volume percent of selective solvent deasphalting unit feedstock.

19. A process for the production of a substantially non-carcinogenic bright stock extract from a reduced hydrocarbon crude feedstock, comprising the steps of:
   (a) establishing a functional relationship by regression between mutagenicity index and a bright stock extract physical property indicative of mutagenicity for a bright stock extract process stream;

(b) determining from said relationship a critical physical property level which, when achieved, a bright stock extract having a mutagenicity index of less than about 1.0 results, said critical property being the physical property which yields a value of mutagenicity index equal to 1.0;

(c) setting process conditions to produce a bright stock extract achieving said critical physical property level; and (d) producing a bright stock extract, said bright stock extract producing step comprising:

(i) passing the reduced feedstock into a vacuum distillation column wherein the feedstock is separated into at least one product of distillation and a vacuum residuum byproduct;

(ii) passing at least a fraction of said residuum byproduct through a selective solvent deasphalting unit to produce a deasphalted raffinate and an asphaltenic extract; and, (iii) passing at least a fraction of said deasphalted raffinate through at least one selective solvent extraction unit to reduce said deasphalted raffinate's aromatic content and to produce a bright stock and the bright stock extract, wherein said bright stock extract is substantially non-carcinogenic having a mutagenicity index of less than about 1.0.

20. The process of claim 19, wherein said physical property is a distillation property.

21. The process of claim 20, wherein said distillation property is a distillation boiling point value.

22. The process of claim 21, wherein said distillation boiling point value is selected from the group consisting of initial boiling point and 5% boiling point.

23. The process of claim 22, wherein the selective solvent of said selective solvent deasphalting unit is propane.

24. The process of claim 22, wherein the selective solvent of said selective solvent extraction unit is a member selected from the group consisting of furfural, phenol, chlorex, nitrobenzene and n-methyl-pyrrolodone.

25. The process of claim 24, wherein the selective solvent is furfural.

26. The process of claim 25, wherein the selective solvent of said selective solvent deasphalting unit is propane.

27. The process of claim 22, wherein an overflash material is produced by step (d) (i) and at least a portion of this material is combined with said vacuum residuum and processed according to steps (d) (ii)–(d) (iii).

28. The process of claim 27, wherein step (c) includes setting an amount of overflash material for combining with said vacuum residuum prior to selective solvent deasphalting.

29. The process of claim 28, wherein said amount of overflash material is selected to provide a maximum bright stock extract yield.

30. The process of claim 29, wherein said amount of overflash material does not exceed about 10 volume percent of selective solvent deasphalting unit feedstock.

31. A process for the production of a non-carcinogenic bright stock extract substantially free from mutagenic activity from a reduced hydrocarbon crude feedstock, comprising the steps of:

(a) establishing a functional relationship by regression between mutagenicity index and a bright stock extract physical property indicative of mutagenicity for a bright stock extract process stream;

(b) determining from said relationship a physical property level which, when achieved, a bright stock extract having a mutagenicity index equal to about 0.0 results, said critical property being the physical property which yields a value of mutagenicity index equal to 0.0;

(c) setting process conditions to produce a bright stock extract achieving said physical property level; and (d) producing a bright stock extract, said bright stock extract producing step comprising:

(i) passing the reduced feedstock into a vacuum distillation column wherein the feedstock is separated into at least one product of distillation and a vacuum residuum byproduct;

(ii) passing at least a fraction of said residuum byproduct through a selective solvent deasphalting unit to produce a deasphalted raffinate and an asphaltenic extract; and, (iii) passing at least a fraction of said deasphalted raffinate through at least one selective solvent extraction unit to reduce said deasphalted raffinate's aromatic content and to produce a bright stock and the bright stock extract, wherein said bright stock extract is substantially free from mutagenic activity having a mutagenicity index of equal to about 0.0.

32. The process of claim 30, wherein said physical property is a distillation property.

33. The process of claim 32, wherein said distillation property is a distillation boiling point value.

34. The process of claim 33, wherein said distillation boiling point value is selected from the group consisting of initial boiling point and 5% boiling point.

35. The process of claim 34, wherein the selective solvent of said selective solvent deasphalting unit is propane.

36. The process of claim 34, wherein the selective solvent of said selective solvent extraction unit is a member selected from the group consisting of furfural, phenol, chlorex, nitrobenzene and n-methyl-pyrrolodone.

37. The process of claim 36, wherein the selective solvent is furfural.

38. The process of claim 37, wherein the selective solvent of said selective solvent deasphalting unit is propane.

39. The process of claim 34, wherein an overflash material is produced by step (d) (i) and at least a portion of this material is combined with said vacuum residuum and processed according to steps (d) (ii)–(d) (iii).

40. The process of claim 39, wherein step (c) includes setting an amount of overflash material for combining with said vacuum residuum prior to selective solvent deasphalting.

41. The process of claim 40, wherein said amount of overflash material is selected to provide a maximum bright stock yield.

42. The process of claim 41, wherein said amount of overflash material does not exceed about 10 volume percent of selective solvent deasphalting unit feedstock.

* * * * *